US009274474B2

(12) United States Patent
Omata et al.

(10) Patent No.: US 9,274,474 B2
(45) Date of Patent: Mar. 1, 2016

(54) FIXING DEVICE

(71) Applicant: CANON KABUSHIKI KAISHA, Tokyo (JP)

(72) Inventors: Masahito Omata, Yokohama (JP); Shoichiro Ikegami, Yokohama (JP); Masahiko Suzumi, Yokohama (JP); Terutaka Endo, Kawasaki (JP); Takeshi Niimura, Yokohama (JP); Takehiko Suzuki, Yokohama (JP); Toshihiko Ochiai, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/482,163

(22) Filed: Sep. 10, 2014

(65) Prior Publication Data

US 2015/0086253 A1 Mar. 26, 2015

(30) Foreign Application Priority Data

Sep. 26, 2013 (JP) ..... 2013-199467

(51) Int. Cl.
*G03G 15/20* (2006.01)

(52) U.S. Cl.
CPC ..... *G03G 15/2085* (2013.01); *G03G 15/206* (2013.01)

(58) Field of Classification Search
CPC ..... G03G 15/206; G03G 15/2085
See application file for complete search history.

(56) References Cited

U.S. PATENT DOCUMENTS

| | | | |
|---|---|---|---|
| 5,148,226 | A | 9/1992 | Setoriyama et al. |
| 5,532,806 | A | 7/1996 | Sugita et al. |
| 7,200,355 | B2 | 4/2007 | Uchiyama et al. |
| 7,203,438 | B2 | 4/2007 | Omata et al. |
| 7,215,899 | B2 | 5/2007 | Kimizuka et al. |
| 7,242,895 | B2 | 7/2007 | Inada et al. |
| 7,280,775 | B2 | 10/2007 | Kubochi et al. |
| 7,873,293 | B2 | 1/2011 | Omata |
| 8,229,338 | B2 | 7/2012 | Nanataki et al. |
| 8,483,603 | B2 | 7/2013 | Nihonyanagi et al. |

(Continued)

FOREIGN PATENT DOCUMENTS

| | | | |
|---|---|---|---|
| JP | 8-184992 | A | 7/1996 |
| JP | 2000-3070 | A | 1/2000 |
| JP | 2001-166621 | A | 6/2001 |

OTHER PUBLICATIONS

European Search Report dated Apr. 17, 2015, issued in European Patent Application No. 14185488.5.

*Primary Examiner* — David Gray
*Assistant Examiner* — Michael Harrison
(74) *Attorney, Agent, or Firm* — Fitzpatrick, Cella, Harper & Scinto

(57) ABSTRACT

The fixing device includes a rotary member for contacting the unfixed toner image, a pressure member for forming the nip portion by contacting the rotary member, and a cover for covering the rotary member with a space between the rotary member and the cover. In a cross section of the fixing device, the cross section being orthogonal to a generatrix direction of the rotary member, the shortest distance (H) between the nip portion and a farthest surface portion of the rotary member farthest away from a surface portion forming the nip portion of the rotary member, the maximum width (W) of the rotary member in the conveyance direction of the recording member, and an area (S) of the space in a range of the maximum width W in the cross section satisfy with a relationship of $S/W \geq 0.7 \times H$.

9 Claims, 12 Drawing Sheets

(56) References Cited

U.S. PATENT DOCUMENTS

| | | | | |
|---|---|---|---|---|
| 8,670,702 | B2 | 3/2014 | Ikegami et al. | |
| 8,712,303 | B2 | 4/2014 | Ando et al. | |
| 8,811,840 | B2 | 8/2014 | Suzuki | |
| 8,811,876 | B2 | 8/2014 | Endo et al. | |
| 8,867,942 | B2 * | 10/2014 | Ikeda et al. | 399/67 |
| 2011/0243598 | A1 | 10/2011 | Suzuki | |
| 2013/0188991 | A1 * | 7/2013 | Kawata et al. | 399/122 |
| 2014/0112692 | A1 | 4/2014 | Omata et al. | |

* cited by examiner

FIXING DEVICE

BACKGROUND OF THE INVENTION

1. Field of the Invention

The present invention relates to a fixing device provided in an electrophotographic image forming apparatus such as a copying machine or a laser beam printer.

2. Description of the Related Art

In general, a fixing device provided in a copying machine or a laser beam printer includes a heating rotary member and performs thermal fixing processing of a toner image with heat from the heating rotary member. There has been known a toner having wax added thereto so as to impart effects such as the adjustment of glossiness of an image and dispersibility of a pigment to the toner and so as to suppress a fixing offset (Japanese Patent Application Laid-Open No. H08-184992).

However, when a toner image is subjected to thermal fixing processing, the wax liquefies and partially remains on the heating rotary member, and gasifies by receiving heat continuously. The gasified wax becomes ultra-fine particles (UFPs) with a diameter of 0.1 micrometer or less and may float in the surrounding space through a surrounding air current in some cases.

It is an object of the present invention to provide a fixing device capable of decreasing the release amount of the UFPs generated from the heating rotary member.

SUMMARY OF THE INVENTION

The purpose of the present invention is to provide a fixing device for fixing an unfixed toner image on a recording material while conveying and heating the recording material bearing the unfixed toner image at a nip portion. The fixing device includes a rotary member for contacting the unfixed toner image, a pressure member for forming the nip portion by contacting the rotary member, and a cover for covering the rotary member with a space between the rotary member and the cover. In a cross section of the fixing device, the cross section being orthogonal to a generatrix direction of the rotary member, assuming that H represents the shortest distance between the nip portion and a farthest surface portion of the rotary member farthest away from a surface portion forming the nip portion of the rotary member, W represents the maximum width of the rotary member in the conveyance direction of the recording member, and S represents an area of the space in a range of the maximum width W in the cross section, S, W and H satisfy with a relationship of $S/W>0.7\times H$.

Further features of the present invention will become apparent from the following description of exemplary embodiments with reference to the attached drawings.

DESCRIPTION OF THE EMBODIMENTS

Exemplary embodiments of the present invention are hereinafter described in detail with reference to the accompanying drawings.

<First Embodiment>

(Image Forming Apparatus)

Figure 2:
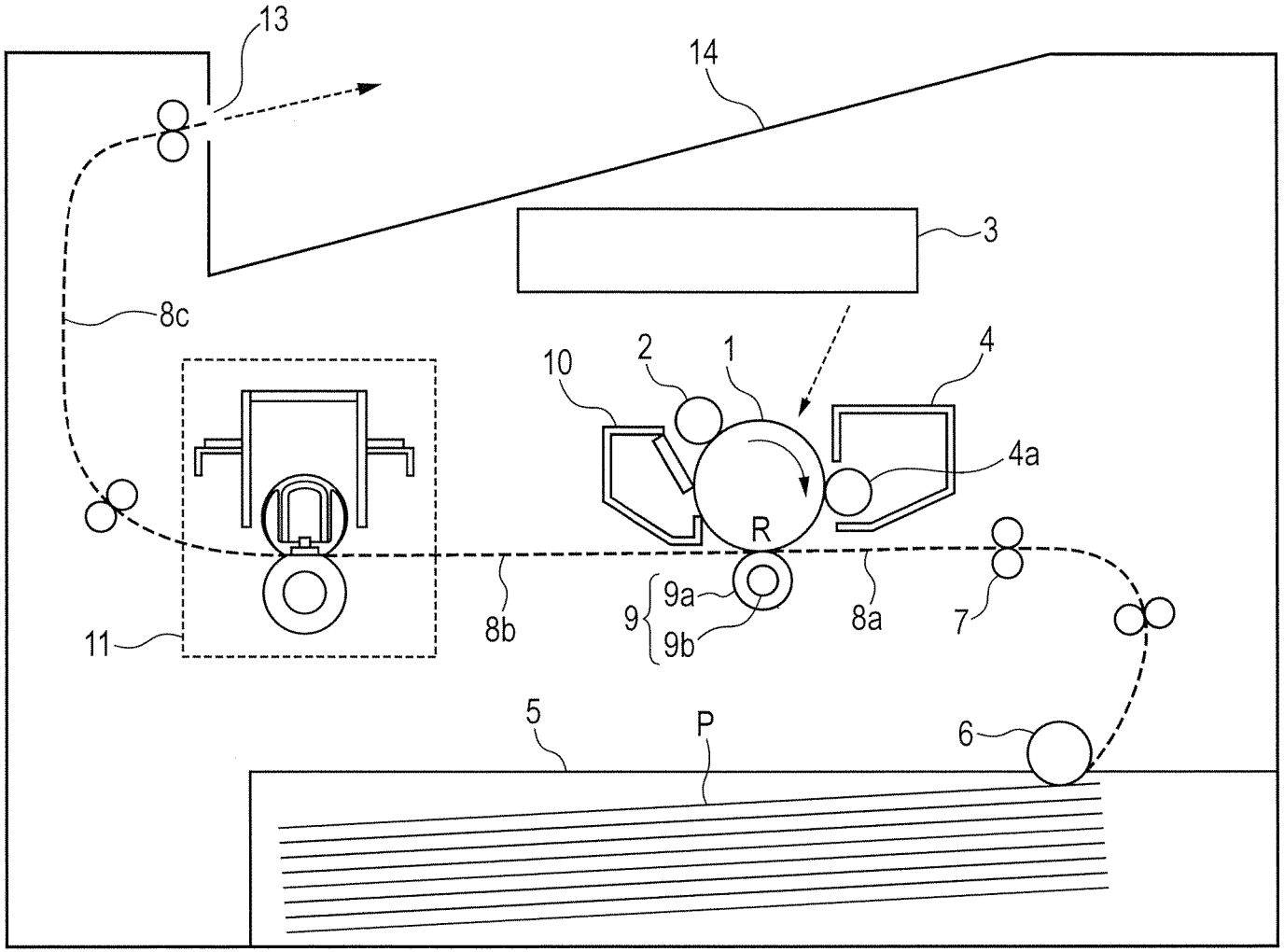
FIG. 2 is a schematic sectional view of an image forming apparatus on which the image heating device according to the first embodiment of the present invention is mounted.

FIG. 2 is a schematic sectional view of an image forming apparatus on which an image heating device according to a first embodiment of the present invention is mounted. An electrophotographic photosensitive drum (hereinafter referred to as "drum") 1 serving an image bearing member in an image forming part is rotationally driven in the arrow direction at a predetermined circumferential velocity (process speed). The surface of the drum 1 is uniformly charged (primarily charged) to a predetermined polarity and potential with a charging roller 2 serving as a charging member.

An exposure unit 3 serves as a laser beam scanner. The exposure unit 3 outputs on-off modulated laser light L in response to a time-series electric digital pixel signal of intended image information input from external appliances such as an image scanner and a computer (not shown) and scans and exposes (irradiates) a charging processing surface of the drum 1 with light. This scanning and exposure removes the charge in an exposure bright section of the surface of the drum 1, with the result that an electrostatic latent image corresponding to the intended image information is formed on the surface of the drum 1.

The surface of the drum 1 is supplied with a developer (toner) from a developing sleeve 4*a* of a developing device 4, and the electrostatic latent image on the surface of the drum 1 is developed successively as a toner image serving as a transferable image. A laser beam printer generally employs a reversal development system involving causing a toner to adhere to the exposure bright section of the electrostatic latent image and developing the toner.

A sheet feed cassette 5 receives recording materials P stacked therein. A sheet feed roller 6 is driven based on a sheet feed start signal, and the recording material P in the sheet feed cassette 5 is fed separately one by one. Then, the recording material P passes through registration rollers 7 and a sheet path 8*a* to be introduced into a transfer part R serving as an abutment nip portion between a transfer roller 9 and the drum 1 at predetermined timing. That is, the conveyance of the recording material P is controlled with the registration rollers 7 so that, when the leading edge portion of the toner image on the drum 1 reaches the transfer part R, the leading edge portion of the recording material P also reaches the transfer part R.

The recording material P introduced into the transfer part R is sandwiched between the drum 1 and the transfer roller 9 and conveyed through the transfer part R. During this time, a transfer voltage controlled in a predetermined manner is applied to the transfer roller 9 from a power source for applying a transfer voltage (not shown). The transfer roller 9 is supplied with the transfer voltage having a polarity opposite to that of the toner, with the result that the toner image of the drum 1 is electrostatically transferred onto the surface of the recording material P at the transfer part R.

The recording material P onto which the toner image has been transferred at the transfer part R is separated from the drum 1 and passes through a sheet path 8*b* to be conveyed and introduced into an image heating device 11. In the image heating device 11, the toner image is heated and fixed onto the recording material P under pressure. On the other hand, the surface of the drum 1 after the separation of the recording material P (after the transfer of the toner image onto the recording material P) is cleaned by the removal of a transfer residual toner, paper powder, and the like with a cleaning device 10, and the drum 1 is used for forming an image repeatedly. Note that, the recording material P having passed through the image heating device 11 is guided to a sheet path 8*c* side and delivered onto a delivery tray 14 from a delivery port 13.

(Image Heating Device)

Figure 1:
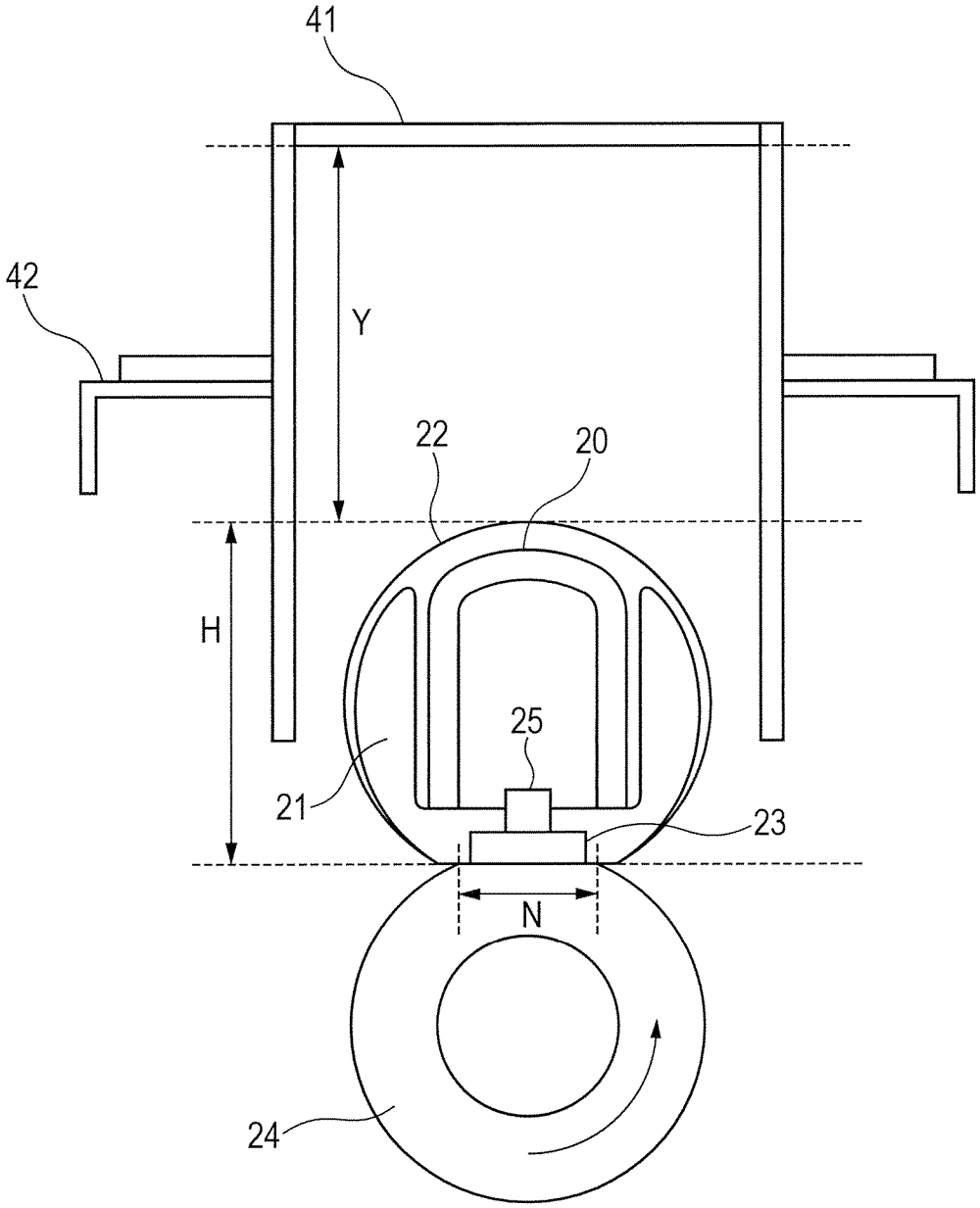
FIG. 1 is a schematic sectional view of an image heating device according to a first embodiment of the present invention.

Next, the image heating device (fixing device) 11 in the first embodiment is described. FIG. 1 is a schematic sectional view of the image heating device of a film heating system according to the first embodiment.

(Fixing Film)

The image heating device 11 of a film heating system uses a tubular heat-resistant film as a heating rotary member to be heated with a heating member. In the image heating device 11, at least part of the perimeter of the film is set to be always free from tension (state which is not supplied with tension), and the belt is rotationally driven with a rotation drive force of a pressure body.

A fixing film 22 serving as a heat-resistant film is externally fitted onto a stay 21 serving as a film guide member including a heating member 23. The inner perimeter of the fixing film 22 is set to be larger by about 3 mm than the outer perimeter of the stay 21 including the heating member 23. Thus, the fixing film 22 is externally fitted onto the stay 21 with a perimeter margin.

The thickness of the fixing film 22 is set to 100 μm or less so as to reduce the heat capacity to enhance the quick start performance. It is preferred to use a heat-resistant single layer film made of polytetrafluoroethylene (PTFE), perfluoroalkoxyalkane (PFA), fluorinated ethylene propylene (FEP), or the like having a thickness of 50 μm or less and 20 μm or more. Alternatively, a composite layer film in which the outer circumferential surface of a film made of polyimide, polyamideimide, polyetheretherketone (PEEK), polyethersulfone (PES), polyphenylene sulfide (PPS), or the like is coated with PTFE, PFA, FEP, or the like can be used. In the first embodiment, the fixing film 22 in which an outer circumferential surface of a polyimide film having a thickness of about 50 μm was coated with PTFE was used, and the outer diameter of the fixing film 22 was set to 18 mm.

(Backup Member)

A film guide 21 serves as a backup member and includes a holding member for holding the heating member 23 and a heat-resistant and rigid member also serving as a guide member for the rotation of the film. A channel member 20 having a substantially U-shaped cross section and made of a sheet metal serves as a rigid member for reinforcing the film guide 21. A ceramic heater is used as the heating member 23 and disposed on a lower surface of the film guide 21 in a stay longitudinal direction (direction crossing the conveyance direction of the recording material P).

The film guide 21 can be formed of a high heat-resistant resin such as polyimide, polyamideimide, PEEK, PPS, or a liquid crystal polymer, or a composite material of those resins and ceramics, a metal, glass, or the like. In the first embodiment, a liquid crystal polymer was used. Further, the substantially U-shaped sheet metal 20 can be formed of a metal such as stainless steel (SUS) or iron.

(Pressure Member)

A pressure roller 24 holds the fixing film 22 together with the heating member 23 to form a nip portion N, and rotationally drives the fixing film 22. The pressure roller 24 serving as a pressure member includes a core bar, an elastic body layer (rubber layer), and a release layer. The pressure roller 24 is arranged so as to be held in pressure-contact with the surface of the heating member 23 across the fixing film 22 with a predetermined pressure force by a bearing unit and a biasing unit (not shown). In the first embodiment, the core bar was made of aluminum, and the rubber layer was made of a silicone rubber. As the release layer, a PFA tube having a thickness of about 30 μm was used. Further, the outer diameter of the pressure roller 24 was set to 20 mm, and the thickness of the elastic body layer (rubber layer) was set to 3 mm.

The pressure roller 24 is opposed to the film guide 21 serving as a backup member through the intermediation of the fixing film 22 and is rotationally driven at a predetermined circumferential velocity in the arrow direction with a drive system (not shown). Due to the rotational drive of the pressure roller 24, a rotation force acts on the fixing film 22 with a friction force between the pressure roller 24 and the outer surface of the fixing film 22 in the nip portion N. Then, the fixing film serving as a belt is driven to rotate in the arrow direction around the outer circumference of the stay 21 at substantially the same circumferential velocity as the rotation circumferential velocity of the pressure roller 24, with the inner surface side of the fixing film 22 being brought into contact with and sliding along the surface of the heating member 23 in the nip portion N.

(Heating Member)

Figure 3:
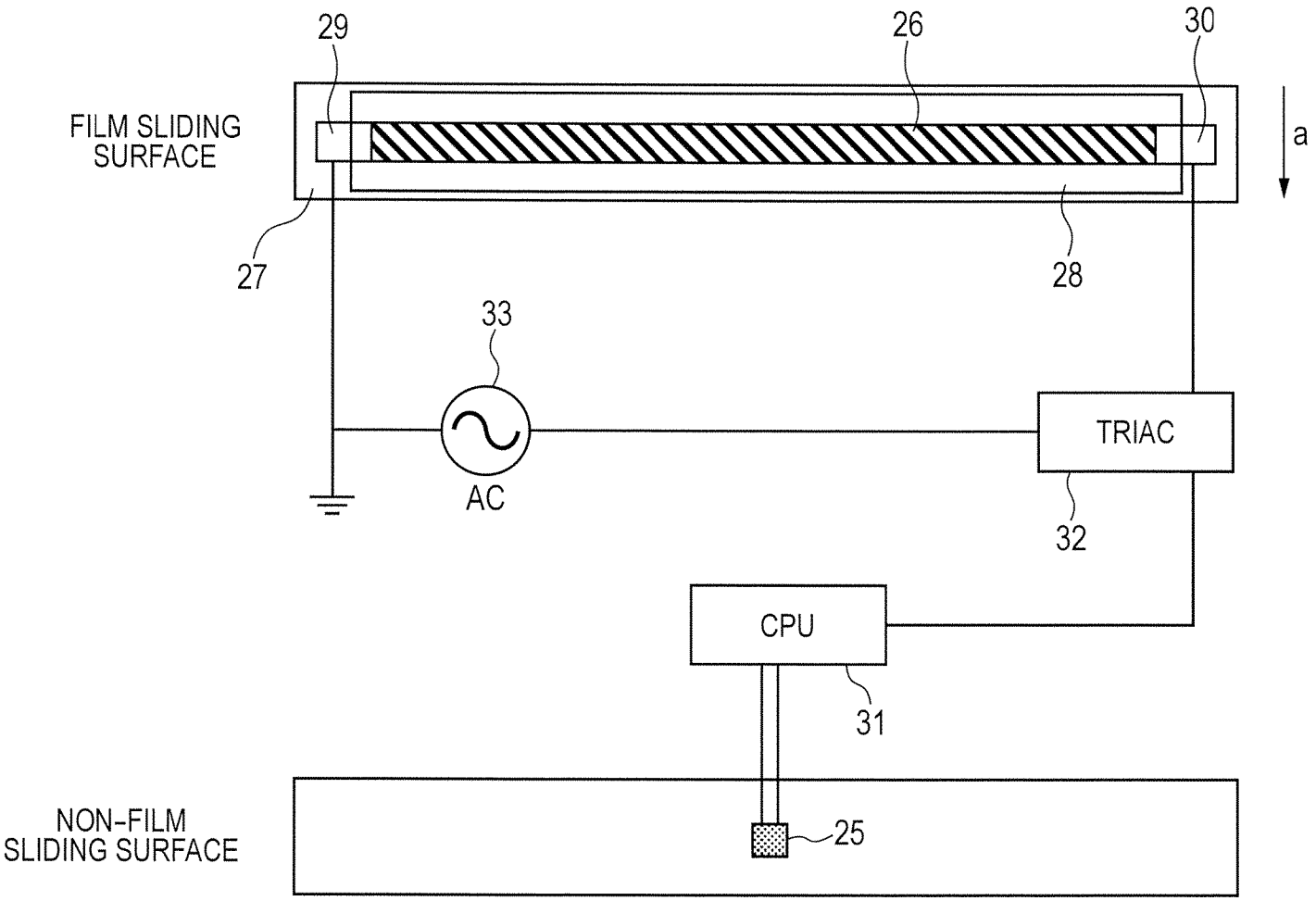
FIG. 3 is a view illustrating a heating member and a circuit for performing current feed control according to the first embodiment of the present invention.

FIG. 3 is a front view of the heating member (heater) 23 serving as a heating member in the first embodiment and a view illustrating a circuit for performing power control. The heating member 23 is provided on an elongated substrate 27 having heat resistance, an insulation property, and satisfactory thermal conductivity, with a direction perpendicular to a conveyance direction "a" of the recording material P serving as a material to be heated being a longitudinal direction. Specifically, a heat generating resistor layer 26 formed in the longitudinal direction of the substrate 27 is provided on the surface (surface which is brought into contact with the fixing film 22) of the substrate 27. The heating member 23 includes a heat-resistant overcoat layer 28 for protecting the surface of the heating member 23 on which the heat generating resistor layer 26 is formed, electrodes 29, 30 for feeding electricity in end portions of the heat generating resistor layer 26 in the longitudinal direction, and the like, and thus forms a heating member with a low heat capacity as a whole.

The heat generating resistor layer 26 in the first embodiment is obtained by forming a paste prepared by kneading silver, palladium, glass powder (inorganic binder), and an organic binder on the substrate 27 of the heating member 23 in a line band shape by screen printing. As the material for the resistance heating member 26, electric resistance materials such as $RuO_2$ and $Ta_2N$ may be used besides silver palladium (Ag/Pd). The resistance of the resistance heating member 26 was set to 20Ω at room temperature.

A ceramics material such as alumina or aluminum nitride is used for the substrate 27. In the first embodiment, a substrate formed of alumina having a width of 7 mm, a length of 270 mm, and a thickness of 1 mm is used. Further, as the electrodes 29, 30 for feeding electricity, a screen printed pattern of silver palladium was used. The overcoat layer 28 of the resistance heating member 26 ensures the electrical insulation property between the heat generating resistor layer 26 and the surface of the heating member 23 and the slidability of the fixing film 22. In the first embodiment, a heat-resistant glass layer having a thickness of about 50 μm was used as the overcoat layer 28.

FIG. 3 also illustrates a back surface (surface which is not brought into contact with the inner surface of the fixing film 22) of the heating member 23. A thermometric element 25 is provided so as to detect the temperature of the heating member 23. In the first embodiment, an external abutment type thermistor separated from the heating member 23 is used as the thermometric element 25. The thermometric element 25 has a configuration, for example, in which a heat insulation layer is provided on a support, an element of a chip thermistor is fixed onto the heat insulation layer, and the element is brought into abutment against the back surface of the heating member 23 with a predetermined pressure force toward a lower side (back surface side of the heating member 23). In the first embodiment, a high heat-resistant liquid crystal polymer was used as the support, and laminated ceramics paper was used as the heat insulation layer. Note that, the thermometric element 25 is provided in a smallest paper-passage region and connected to a CPU 31.

The surface side of the heating member 23 on which the overcoat layer 28 is formed is exposed downward and held on the lower surface side of the stay 21 to be fixed thereto. Due to the above-mentioned configuration, the entire heating member and fixing film is allowed to have a heat capacity lower than that of a thermal roller system, and quick start is enabled.

Here, when the heating member 23 supplies electricity to the electrodes 29, 30 for feeding electricity in the end portions of the heat generating resistor layer 26 in the longitudinal direction, the heat generating resistor layer 26 generates heat in the entire region in the longitudinal direction to increase in temperature. The increase in temperature is detected with the thermometric element 25, and the output of the thermometric element 25 is subjected to A/D conversion to be taken in the CPU 31. Then, based on the information, a triac 32 controls the power to be supplied to the heat generating resistor layer 26 through phase control or wave number control, with the result that the temperature of the heating member 23 is controlled.

Specifically, the heating member 23 is kept at a predetermined temperature during fixing by controlling the current feed so that the heating member 23 increases in temperature when the detected temperature of the thermometric element 25 is lower than a predetermined setting temperature and the heating member 23 decreases in temperature when the detected temperature of the thermometric element 25 is higher than the predetermined setting temperature. Note that, in the first embodiment, the output is changed in 21 stages in steps of 5% from 0 to 100% through phase control. The output of 100% refers to an output obtained when the current feed of 100% is performed with respect to the heating member 23.

In a state in which the temperature of the heating member 23 increases to a predetermined temperature, and the rotation circumferential velocity of the fixing film 22 caused by the rotation of the pressure roller 24 is made steady, the recording material P is introduced from the transfer part into the nip portion N formed by the heating member 23 and the pressure roller 24 with the fixing film 22 being sandwiched therebetween. When the recording material P and the fixing film 22 serving as a belt are sandwiched between the heating member 23 and the pressure roller 24 and conveyed through the pressure-contact nip portion N, the heat of the heating member 23 is imparted to the recording material P via the fixing film 22.

Accordingly, the unfixed image (toner image) on the recording material P is fixed by heating onto the surface of the recording material P. The recording material P having passed through the nip portion N is separated from the surface of the fixing film 22 and conveyed.

(Retaining Member)

Figure 4:
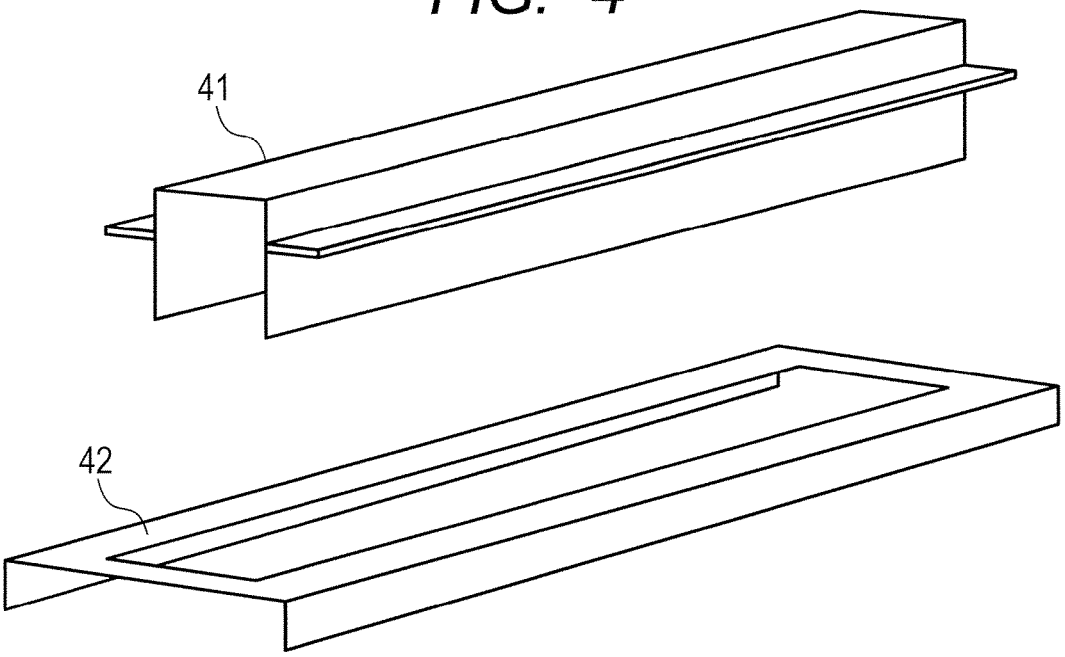
FIG. 4 is a perspective view of a retaining member and a top plate frame in the first embodiment of the present invention.

A retaining member (cover member) 41 is fixed to the image heating device (fixing device) 11 with a top plate frame 42 of the image heating device 11. FIG. 4 is a perspective view of the retaining member 41 and the top plate frame 42, and the retaining member 41 is configured so as to cover portion (opposite side to the nip portion N) of the fixing film 22 serving as a belt from outside of the fixing film 22. As the material for the retaining member 41, a high heat-resistant resin such as polyimide, polyamideimide, PEEK, PPS, or a liquid crystal polymer, a material such as ceramics, a metal, or a heat resistant glass, or a composite material thereof is used.

Before describing the role of the retaining member 41, a mechanism in which UFPs are generated from toner wax is described below. Wax in a toner liquefies due to the heat and pressure generated when a toner image T passes through the nip portion N and seeps through the surface of the toner from inside of the toner. At this time, part of the wax gasifies and is released to the air. Further, part of the wax, although it is a trace amount, remains on the fixing film side even after the recording material P passes through the nip portion N and gasifies by receiving heat from the fixing film 22 continuously. The gasified wax forms UFPs with a diameter of 0.1 micrometer or less in a liquid phase or a solid phase depending on the ambient temperature. The UFPs float in the surrounding air through a surrounding air current.

The floating UFPs are likely to be flocculated when floating for a long time period and are likely to be adsorbed by the surrounding members. Further, as the UFPs float in a higher concentration, the UFPs are more likely to be flocculated. Therefore, in order to allow the flocculation to proceed, it is preferred that an air current carrying the UFPs be retained on the periphery of a generation source to the extent possible.

Therefore, it is preferred that the retaining member 41 cover the periphery of the fixing film 22 serving as a generation source of the UFPs to retain the UFPs immediately after the generation in the space of the retaining member temporarily, that is, to set the air current carrying the UFPs to be slow, and to set the path of the air current carrying the UFPs to be long. Thus, the flocculation of the UFPs and the adsorption thereof by the peripheral member can be accelerated, and the output number of the UFPs can be decreased.

(Arrangement of retaining member)

Figure 5:
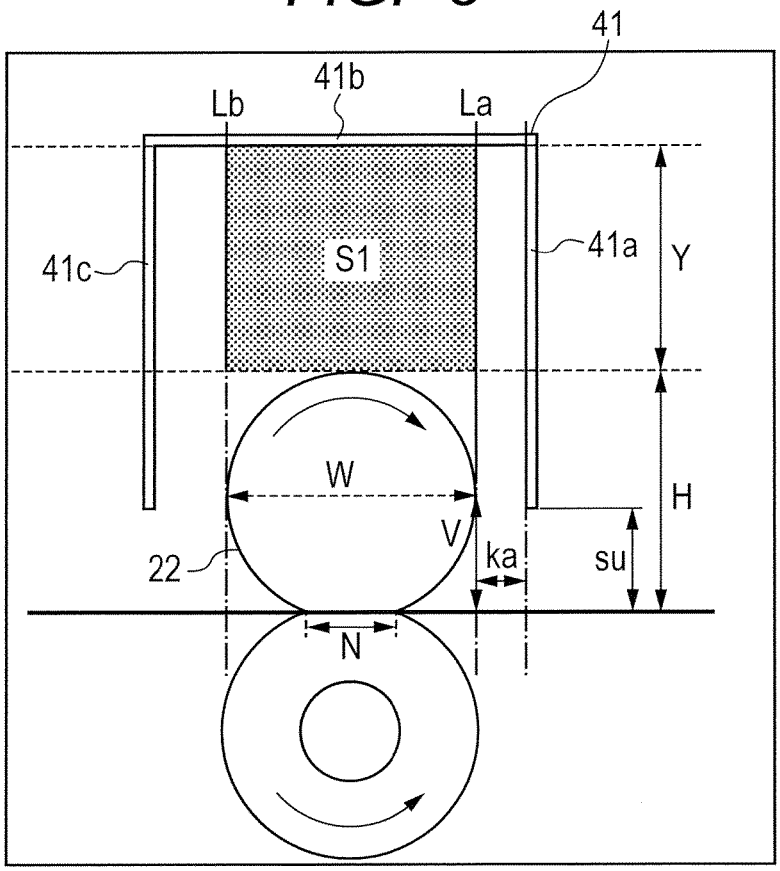
FIG. 5 is a view illustrating the definitions of main dimensions of the retaining member in the first embodiment of the present invention.

Here, before describing the arrangement of the retaining member 41, the main portions thereof are defined as illustrated in FIG. 5. First, the maximum height of the fixing film 22 in a cross section orthogonal to a rotation axis direction (generatrix direction) of the fixing film 22 serving as a heating rotary member from the conveyance surface of a recording material (recording material conveyance surface) is defined as "H". Alternatively, "H" can also be defined as the shortest distance between the nip portion N and a surface portion of the fixing film 22 on an opposite side to a surface portion of the fixing film 22 forming the nip portion N. Further, the maximum width of the fixing film 22 in the conveyance direction of the recording material is defined as "W", and a tangent on the fixing film 22, which is orthogonal to the conveyance direction of the recording material on an upstream side in the conveyance direction of the recording material with respect to the nip portion in this case, is defined as "La". Further, a tangent on the fixing film 22, which is orthogonal to the conveyance direction of the recording material on a downstream side in the conveyance direction of the recording material with respect to the nip portion in this case, is defined as "Lb". Further, the height of the fixing film 22 from the recording material conveyance surface at a position on the upstream side where the fixing film 22 has a maximum width in the conveyance direction of the recording material is defined as "V".

The retaining member 41 includes, with respect to the fixing film 22, a portion (first cover portion 41*a*) on the upstream side of the conveyance direction of the recording material with respect to the nip portion N, a portion (third cover portion 41*c*) on the downstream side thereof, and a ceiling part (second cover portion 41*b*) T serving as an opposed surface on an opposite side to the fixing film 22 with respect to a plane brought into contact with the maximum height portion of the fixing film 22 (hereinafter referred to as the maximum height plane of the fixing film 22). The ceiling part T is a part of the retaining member 41, which is provided on an opposite side to the pressure roller 24 with respect to the fixing film 22.

Here, a space region surrounded by a plane including the tangent La on the upstream side, a plane including the tangent Lb on the downstream side, the maximum height plane of the fixing film 22, and the ceiling part T is defined as "S1". Alternatively, "S1" can also be defined as an area of a region between the fixing film 22 and the retaining member 41 in the range of W. The height of a tip end of a surface in an upstream side portion of the retaining member 41 from the recording material conveyance surface is defined as "su", and the minimum interval (shortest distance) between the fixing film 22 and the upstream side portion of retaining member 41 in the conveyance direction of the recording material is defined as "ka". Alternatively, "ka" can also be defined as the shortest distance between a surface portion of the fixing film 22 on the upstream side of the nip portion N in the conveyance direction of the recording material and a portion of the retaining member 41 on the upstream side of the nip portion N in the conveyance direction of the recording material (first cover portion 41*a*). Further, "su" can also be defined as the shortest height between a virtual line extending from the nip portion N to the upstream side of the nip portion N in the conveyance direction of the recording material and the portion of the retaining member 41 on the upstream side of the nip portion N in the conveyance direction of the recording material (first cover portion 41*a*).

The height su is set to be smaller than the height V. Further, the minimum interval (shortest distance) ka is set to 5 mm or less, more preferably from 2 mm to 5 mm. Thus, the speed of an air current carrying the UFPs can be decreased for the following reason with reference to FIGS. 6A and 6B.

Figure 6A:
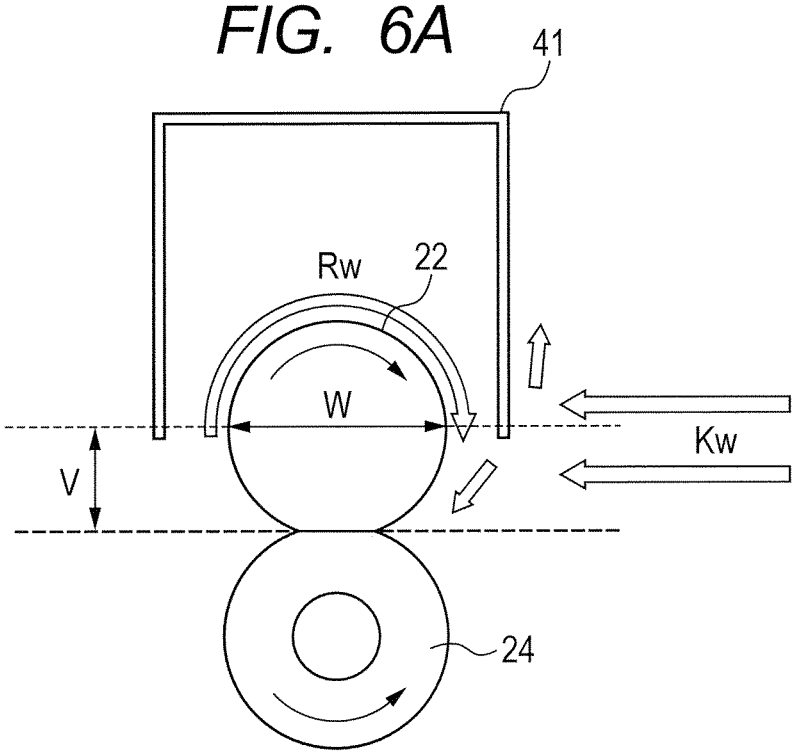
FIG. 6A is a view illustrating an air current in the case where a tip end position of an upstream side portion of the retaining member is lower than the height of the position of an upstream side end portion of a belt.
Figure 6B:
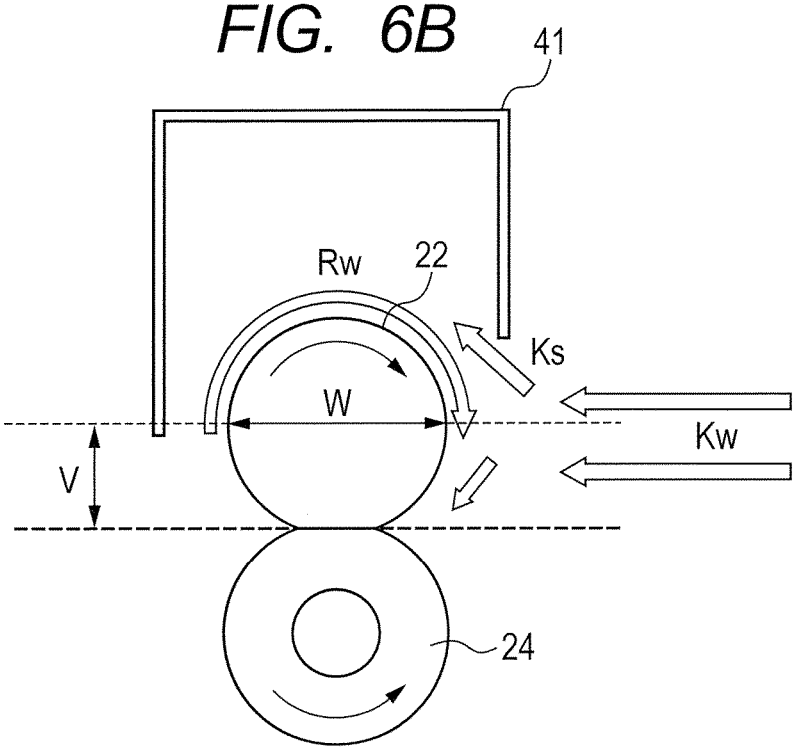
FIG. 6B is a view illustrating an air current in the case where the tip end position of the upstream side portion of the retaining member is higher than the height of the position of the upstream side end portion of the belt.

In the first embodiment, the retaining member 41 uses an air current caused by the driving of the fixing film 22 so as to retain the UFPs generated from the periphery of the fixing film 22 in the retaining member 41. That is, due to the rotation of the fixing film 22 caused by the driving of the pressure roller 24, an air current Rw (hereinafter referred to as "laminar flow Rw") as illustrated in FIGS. 6A and 6B is generated on the surface of the fixing film 22. On the other hand, in general, a flow of wind caused by the conveyance of the recording material and a flow of wind from the inside of a main body for releasing heat of the image heating device 11 to outside of the main body are present on the periphery of the image heating device (fixing device) 11, and an air current Kw flows to the fixing device 11 in the conveyance direction of the recording material.

Here, in the case where the height su is smaller than the height V (FIG. 6A), the air current Kw is blocked by the upstream side portion of the retaining member 41 in the conveyance direction of the recording material or strikes a lower half of the fixing film 22. Therefore, although there is an air current which flows into the inner space of the retaining member 41 while going around the upstream side portion (being weakened eventually), the air current Kw is not likely to flow into the inside of the retaining member 41 directly.

On the other hand, in the case where the height su is larger than the height V (FIG. 6B), the air current Kw is not blocked (not weakened eventually) by the upstream side portion of the retaining member 41 in the conveyance direction of the recording material. The air current Kw is liable to flow into the space between the surface of the fixing film 22 and the retaining member 41 directly, and an air current Ks that directly flows into the inner space of the retaining member 41 is generated.

Here, the time period during which the UFPs are retained in the retaining member 41 is desired to be longer to the extent possible, and hence it is desired that the wind flowing from the upstream side to the downstream side of the nip portion N in the conveyance direction of the recording material in the retaining member 41 be weakened to the extent possible. In order to achieve this, it is necessary to prevent inflow air Ks, which directly flows into the inside of the retaining member 41, from being generated, that is, to set the height of the tip end of the upstream side portion of the retaining member 41 in the conveyance direction of the recording material to the height V or less (more preferably less than the height V).

Further, in order to further weaken an air current which flows into the inside of the retaining member 41, it is preferred that the clearance (minimum interval) ka between the upstream side portion of the retaining member 41 in the conveyance direction of the recording material and the fixing film 22 be minimized so as to cause the inflow air current to strike the laminar flow Rw. Here, in general, due to the generation of the laminar flow Rw, the space in a range of 5 mm from the surface of the fixing film 22 is influenced by the laminar flow Rw, and the value of the minimum interval ka preferably falls within a range of 5 mm or less. Considering the interference caused by the component tolerance and rattling of the image heating device 11, substantially, it is more preferred that the value of the minimum interval ka fall within a range of from 2 mm to 5 mm.

In FIG. 6A, the UFPs move through the air current Ks which has flowed into the inside of the retaining member 41, although a trace amount of the air current Ks goes around the upstream side portion. As the retention time of the UFPs inside the retaining member 41 is longer, more flocculation of the UFPs occurs. The air current Ks flows into the inside of the retaining member 41 while being weakened with the laminar flow Rw through the side of the upstream side portion of the retaining member 41 in the conveyance direction of the recording material, and hence the inflow direction becomes substantially the tangent La as indicated by the black arrow of FIG. 7.

Figure 7:
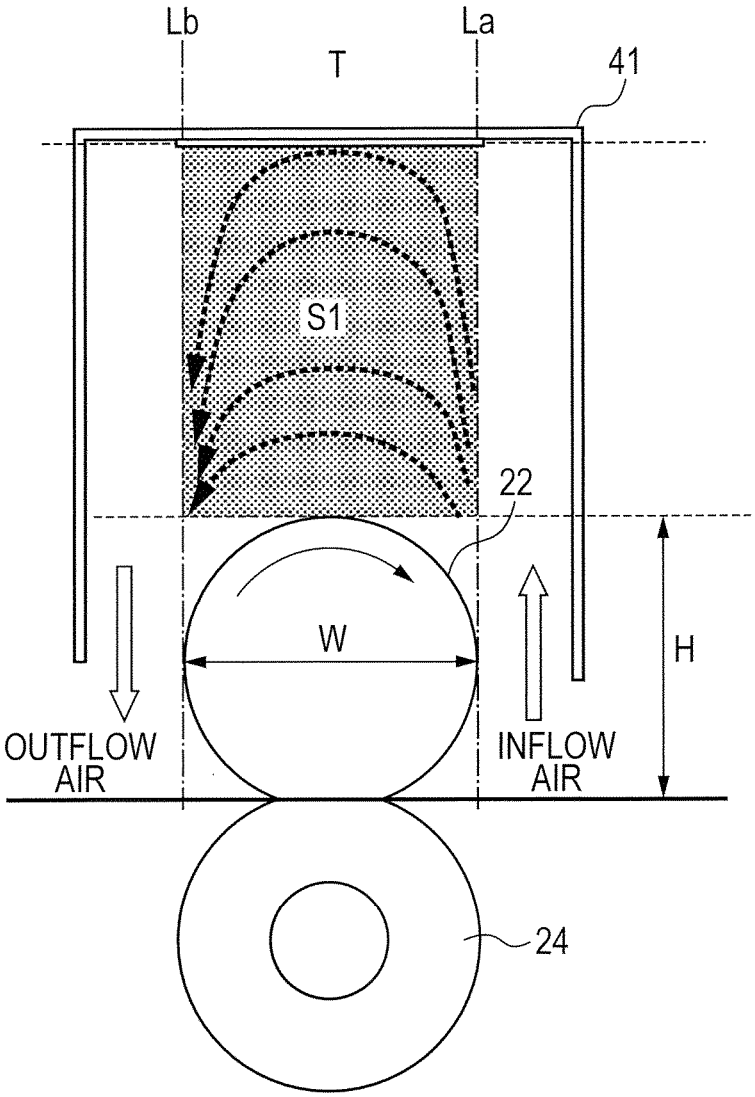
FIG. 7 is a view illustrating inflow air on an upstream side of the retaining member, outflow air on a downstream side thereof, and floating of UFPs in a floating space in the first embodiment of the present invention.

Further, the outflow air that returns from the ceiling part T of the retaining member 41 parallel to the conveyance direction of the recording material directly flows to an exit directly as indicated by the open arrow of FIG. 7. Therefore, the retention period of the UFPs flowing through the air current Ks eventually becomes proportional to the height of the area S1, that is, S1/W. Specifically, when the S1/W is taken to be large, the path for an air current carrying the UFPs can be taken to be long. In the following, the S1/W is defined as a parameter Y as in Expression 1 in a system in which the area S1 is defined.

$$Y=S1/W \quad (1)$$

The parameter Y corresponds to the height of the ceiling part T of the retaining member 41 from the maximum height plane of the fixing film 22 in the first embodiment. However, for example, in the case where the ceiling part T of the retaining member 41 is not in a plane parallel to the recording material conveyance surface, but is in a plane having an inclined surface, is a curved surface, or has a difference in level, the parameter Y corresponds to the average height of the fixing film 22 from the maximum height plane thereof to the ceiling part T.

It is preferred that the parameter Y satisfies the following Expression 2.

$$Y=S1/W\geq 0.7\times H \quad (2)$$

More preferably, the parameter Y satisfies the following Expression 3.

$$Y=S1/W\geq 0.9\times H \quad (3)$$

When the parameter Y satisfies Expression 3, the number of the UFPS can be decreased by 50% more.

When the parameter Y satisfies Expression 3, the number of the UFPs can be decreased stably as described below in detail. Then, even when a component dimension tolerance, thermal expansion deformation, assembly rattling, and the like are caused in the image heating device 11, the number of the UFPs can be decreased stably. The ratio of the parameter Y to the height H is hereinafter described.

(Ratio of Parameter Y to H)

FIG. 1 is a schematic sectional view of the image heating device 11 according to the first embodiment. The fixing film 22 having an outer diameter of 18 mm was used. When the fixing film 22 is incorporated into the image heating device 11 (FIG. 2), the surface shape of the fixing film 22 is supported by the film guide 21 and crushed by the nip portion N between the film guide 21 and the pressure roller 24, with the result that the fixing film 22 is deformed into an oval shape stretched in the conveyance direction of the recording material compared to a circular shape. The height H, width W, and height V of the fixing film 22 incorporated into the image heating device 11 were actually measured to be 15 mm, 20 mm, and 7.5 mm, respectively.

Figure 8:
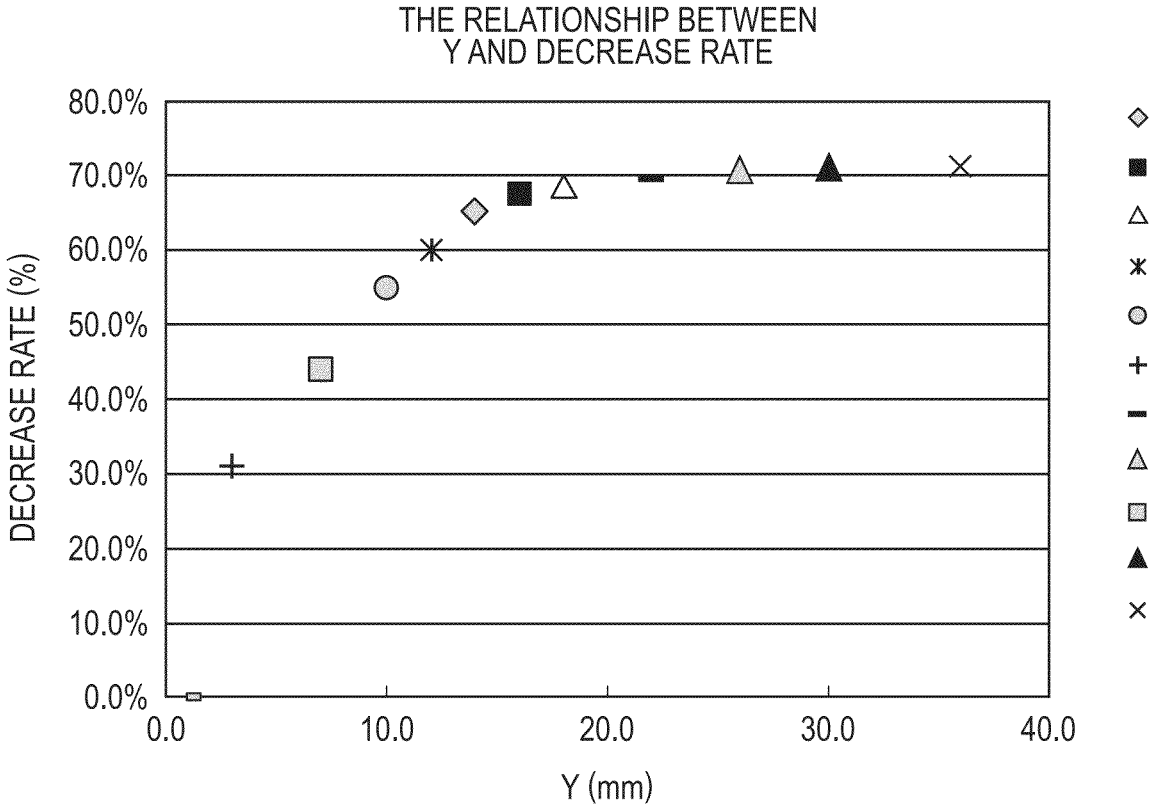
FIG. 8 is a graph showing a relationship between the height of the floating space and the UFP decrease rate in the first embodiment of the present invention.

Polyetheretherketone (PEEK) was used as the material for the retaining member 41, and the height su of the tip end of the upstream side portion of the retaining member 41 in the conveyance direction of the recording material from the recording material conveyance surface was set to 6 mm, and the minimum interval (shortest distance) ka between the retaining member 41 and the fixing film 22 in the conveyance direction of the recording material was set to 3 mm. Table 1shows the results obtained by measuring the number (concentration) of the UFPs which are to flow out by changing the parameter Y by changing the height of the ceiling part T of the retaining member 41 from the film apex in such an image heating device. Further, FIG. 8 is a graph showing a relationship between the parameter Y and the decrease rate of Table 1.

Figure 9A:
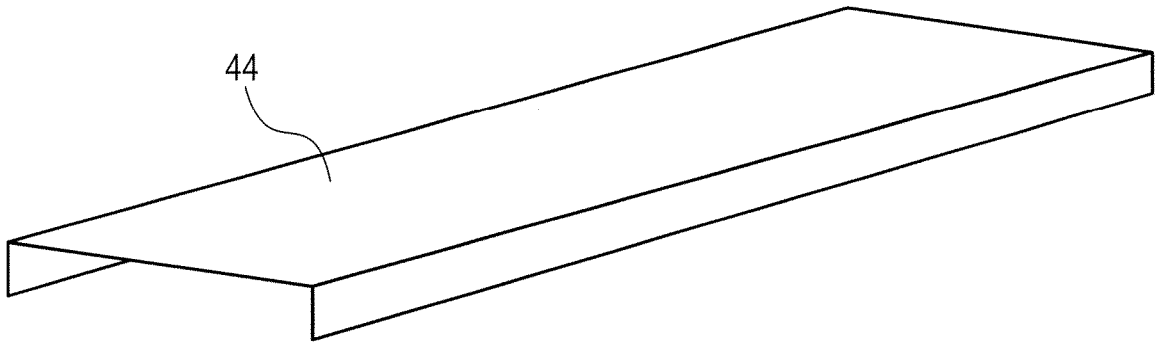
FIG. 9A is a view illustrating a top plate frame in an image heating device not including a retaining member as Comparative Example (Ref).
Figure 9B:
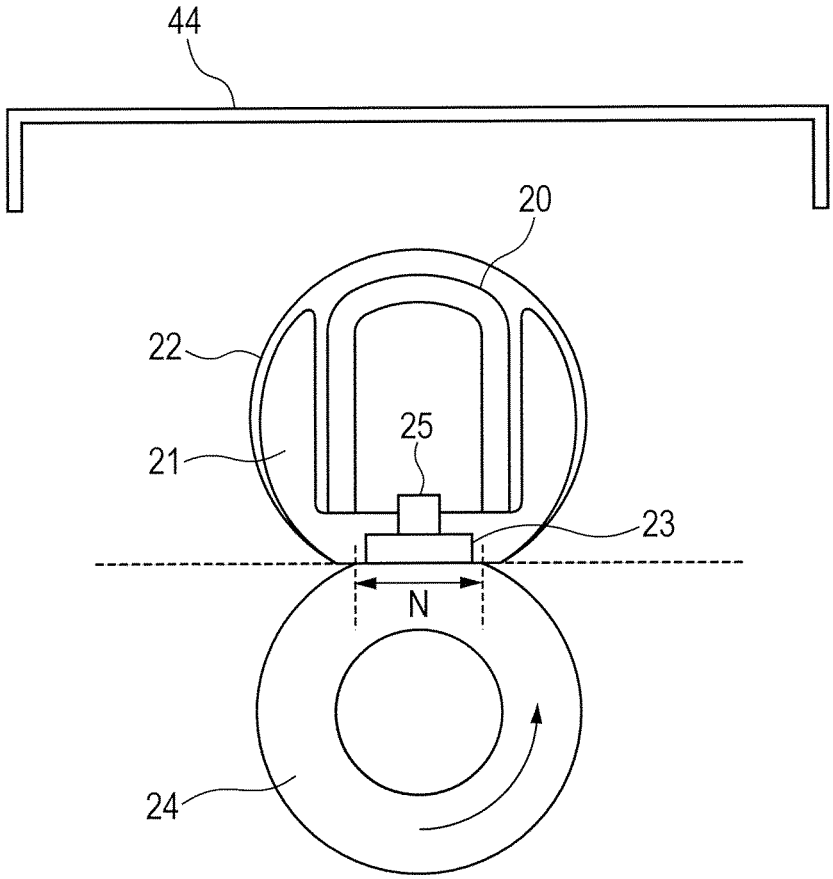
FIG. 9B is a schematic sectional view of the image heating device not including a retaining member.

Note that Table 1 shows the results obtained by performing an experiment with respect to a configuration (FIGS. 9A and 9B) not having the retaining member 41 as Comparative Example (Ref). Comparative Example (Ref) has the following configuration. The position of an upstream end of a top plate frame 44 in a conveyance direction of a recording material is sufficiently away from a conveyance surface of the recording material, and the top plate frame 44 does not cover a fixing film, unlike the case of the retaining member 41. In this configuration, a space S1 in which UFPs are retained is not considered to be present, and hence it is not considered that there is a parameter Y.

Further, a method of evaluating a UFP suppression effect involving filling a sealed chamber of 3 cubic meters with purified air, disposing an image forming apparatus in the chamber, and measuring the concentration of UFPs in the chamber immediately after printing an image of a printing ratio of 5% continuously for 5 minutes. For the measurement, a fast mobility particle sizer (FMPS 3091) (manufactured by TSI Holdings Co., Ltd.) was used. Further, as the image forming apparatus, a 40 ppm monochromatic laser beam printer (LBP) having a process speed of about 230 mm/sec was used.

TABLE 1

| | Y | Decrease rate % |
|---|---|---|
| Example 1 | 15 | 66% |
| Example 2 | 16 | 68% |
| Example 3 | 18 | 69% |
| Example 4 | 22 | 70% |

TABLE 1-continued

| | Y | Decrease rate % |
|---|---|---|
| Example 5 | 26 | 71% |
| Example 6 | 30 | 71% |
| Example 7 | 36 | 71% |
| Example 8 | 13.5 | 63% |
| Example 21 | 12 | 60% |
| Example 22 | 10 | 55% |
| Comparative Example 3 | 7 | 44% |
| Comparative Example 4 | 3 | 31% |
| Comparative Example (Ref) | — | 0% |

The decrease rate in Table 1 refers to a value indicating the decrease in UFP concentration (pieces/$cm^3$·sec) with respect to the UFP concentration of Comparative Example (Ref) in terms of a rate. Table 1 shows that the concentration is preferably lower (decrease rate is preferred to be higher), and the effect is more stable when a change in decrease rate is small with respect to the variation in the parameter Y.

As illustrated in FIG. 8, when a decrease rate (%) is plotted by changing the parameter Y (mm) corresponding to the height of the retention space, the decrease rate increases along with an increase in the parameter Y. In case where the parameter Y is 10 (mm) or more, the parameter Y satisfies Expression 2. The decrease rate is over 50%. In the case where the parameter Y is 13.5 (mm) or more, that is, the parameter Y satisfies Expression 3, the decrease rate (%) is substantially saturated (the change in concentration when the parameter Y changes by 1 mm (concentration/Y) is 2% or less).

The reason that the decrease rate is saturated with respect to an increase in the parameter Y is hereinafter described. As a basic property of the UFPs, there is a limit value of particles to be generated by flocculation. That is, as the retention time is longer, there is more flocculation of the UFPs, and the particle size of the UFPs increases. However, even when the retention space S1 is enlarged, there is a limit to the enlargement of the particles.

As a result of the actual measurement, the maximum particle diameter of the UFPs in Examples 1 to 8 in Table 1 was about 250 nm, and the number of the UFPs was almost equal in the respective examples. Further, in Example 21, the maximum particle diameter was 250 nm. In Examples 22, Comparative Example 3 and Comparative Example 4, the maximum particle diameter was less than 250 nm. In Comparative Example (Ref), the maximum particle diameter was smallest (about 175 nm). Note that, the maximum particle diameter as used herein refers to a maximum value of a particle distribution measured by the fast mobility particle sizer (FMPS 3091) (manufactured by TSI Holdings Co., Ltd.) used for measuring the UFPs.

The reason for the upper limit of the particle diameter of the UFPs in the measurement results is considered as follows. There is a limit to the particle diameter for particle generation in an accumulation mode (particle generation process by flocculation) in aerosol in the air (in general, the upper limit is said to be on the order of several hundred nm).

Due to the upper limit of the particle diameter of the UFPs of about 250 nm as described above, as the retention space S1 is larger, there is more flocculation. However, the flocculation is saturated, and the flocculation effect becomes substantially unchanged. That is, it is considered that, consequently, the UFP flocculation effect (UFP decrease effect) is saturated when the retention space of the retaining member reaches a certain capacity or more.

Next, an experiment was performed, which involves changing the height su of the tip end of the upstream side portion of the retaining member 41 in the conveyance direction of the recording material from the recording material conveyance surface and the minimum interval (shortest distance) ka between the retaining member 41 and the fixing film 22 in the conveyance direction of the recording material, based on the configuration (Y=22 (mm)) of Example 4 in Table 1. Table 2 shows the results obtained by measuring the number (concentration) of the UFPs which are to outflow when the height su and the minimum interval ka are changed.

TABLE 2

| | su | ka | Decrease rate % |
|---|---|---|---|
| Example 4 | 6 | 3 | 70% |
| Example 9 | 6 | 2 | 70% |
| Example 10 | 6 | 5 | 69% |
| Example 11 | 7.5 | 3 | 69% |
| Example 12 | 3 | 3 | 70% |
| Comparative Example 5 | 6 | 7 | 55% |
| Comparative Example 6 | 6 | 10 | 40% |
| Comparative Example 7 | 9 | 3 | 50% |
| Comparative Example (Ref) | — | — | 0% |

As is understood from the results of Table 2, when the height su is 7.5 mm or less (more preferably less than 7.5 mm), that is, the height su is equal to or less than the height V (preferably less than the height V), the effect (decrease rate) is highly stable. When the height su is larger than the height V, the effect (decrease rate) decreases rapidly. The reason for this is considered as follows. As described above, when the height su is larger than the height V, inflow air is directly generated, and the effect (decrease rate) decreases rapidly. Here, the expression V=H/2 is satisfied, and hence the effect (decrease rate) is highly stable when the expression su≤H/2 (more preferably su<H/2) is satisfied.

Further, the minimum interval ka is stable as long as the minimum interval ka falls within a range of 5 mm or less (ka≤5 mm). However, when the minimum interval ka is more than 5 mm, the decrease rate decreases rapidly. The reason for this is considered as follows. The thickness of the laminar flow Rw is 5 mm or less.

Further, as a result of studying the decrease rate of the UFPs by changing the absolute value of an outer diameter of the fixing film 22, rendering the process speed variable within a range of from 60 mm/sec to 400 mm/sec, and similarly changing the height su and the minimum interval ka, it was found that the height su is preferred to be equal to or less than the height V in the same way as described above. Further, it is found that the minimum interval ka is preferred to fall within a range from 2 mm to 5 mm in the same way as described above.

That is, in the first embodiment, the parameter Y satisfies the expression Y=S1/W≥0.7×H, the height su satisfies the expression su≤H/2, and the minimum interval ka satisfies the expression 2 mm≤ka≤5 mm. More preferably, the parameter Y satisfies the expression Y=S1/W≥0.9×H, the height su satisfies the expression su≤H/2, and the minimum interval ka satisfies the expression 2 mm≤ka≤5 mm.

Figure 10A:
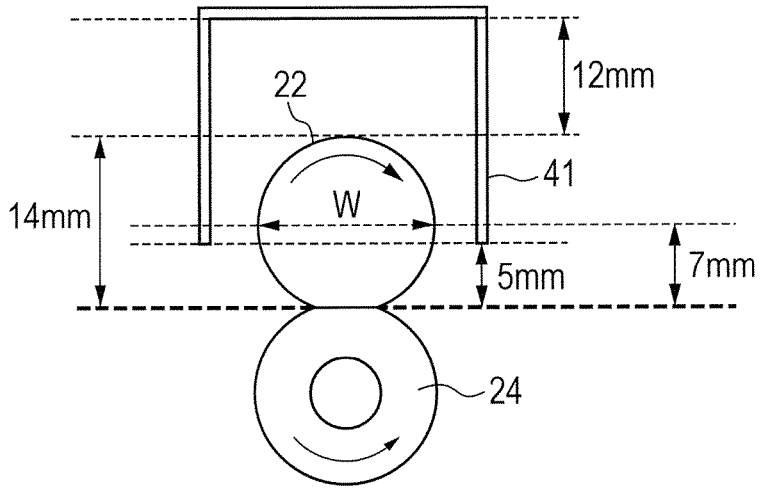
FIG. 10A is a schematic sectional view in the case where the upstream side portion and downstream side portion of the retaining member do not extend in a conveyance direction.
Figure 10B:
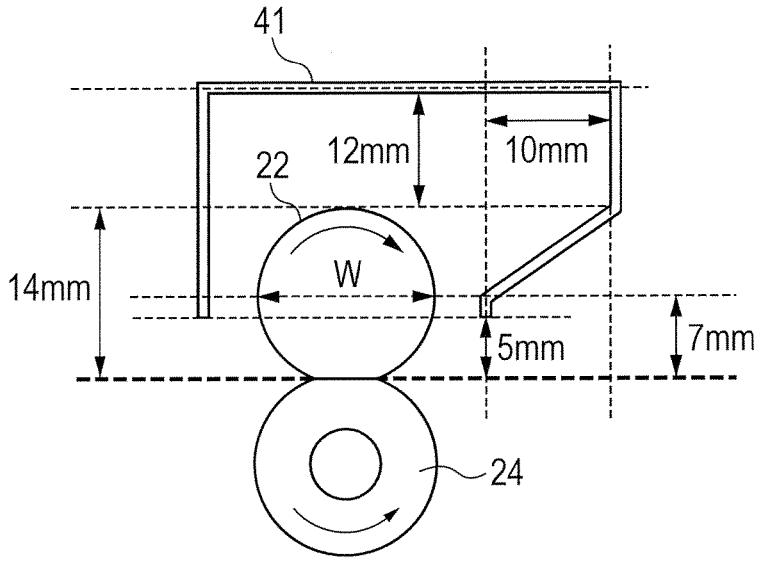
FIG. 10B is a schematic sectional view in the case where the upstream side portion of the retaining member extends in the conveyance direction.
Figure 10C:
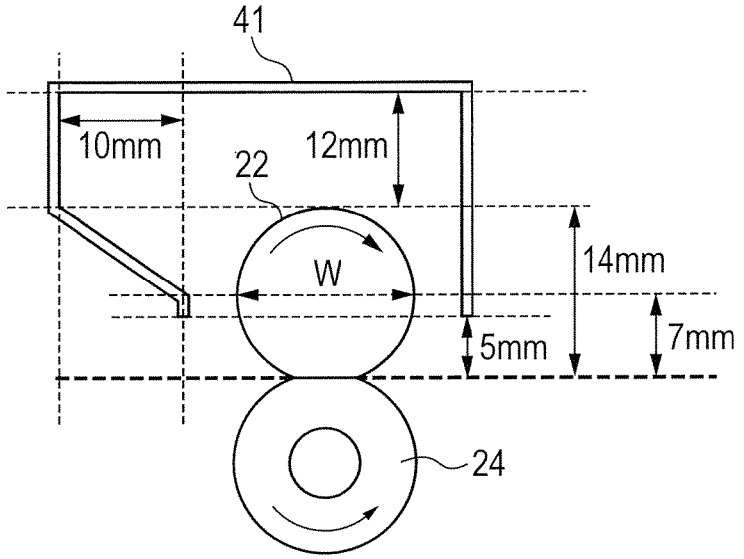
FIG. 10C is a schematic sectional view in the case where the downstream side portion of the retaining member extends in the conveyance direction.

Next, Example 21a illustrated in FIG. 10B and Comparative Example 21b illustrated in FIG. 10C are obtained by extending the retaining member 41 in the conveyance direction of the recording material in the configuration of Example 21 illustrated in FIG. 10A of Table 1. Table 3 shows the results obtained by measuring the number (concentration) of the UFPs that are to outflow in this case.

TABLE 3

| | Y | Decrease rate % |
|---|---|---|
| Example 21 | 12.0 | 60% |
| Example 21a | 12.0 | 60% |
| Example 21b | 12.0 | 60% |

As is understood from the results of Table 3, no substantial difference is found in any of the configurations, and the configurations remain almost unchanged even by the extension in the conveyance direction. That is, even when the retaining member 41 is extended in the conveyance direction of the recording material, the UFP decrease effect remains unchanged. The reason for this is considered as follows. An air current having flowed into the space in the retaining member 41 maintains its inflow angle as much as possible (the air current flows into the space substantially perpendicularly to the recording material conveyance surface) as described above. That is, it is considered that a main air current hardly flows into the space on an upstream side in the conveyance direction of the recording material further from the height su.

Further, the outflow air is to flow to a shortest path (path substantially perpendicular to the recording material conveyance surface) toward the exit, and hence it is considered that a main air current hardly flows into the space on a downstream side in the conveyance direction of the recording material. Note that, although the extension effect is hardly obtained, the configuration that the retaining member 41 is extended in the conveyance direction of the recording material may be used.

As described above, the satisfactory UFP decrease effect can be obtained by forming the retaining member 41 in a desired shape, that is, disposing the upstream side portion of the retaining member 41 in the conveyance direction of the recording material at a predetermined position (setting the height su and the minimum interval ka) and setting the parameter Y within a predetermined numerical value range. Then, the area S1 may be changed due to the tolerances of the retaining member 41 and the components around the retaining member 41, the thermal expansion of the components, or the assembly rattling of a heating fixing device. However, in the first embodiment, even when the area S1 is changed, the high UFP decrease effect can be obtained substantially stably.

<Second Embodiment>

The second embodiment is the same as the first embodiment except for that a retaining member includes wall parts (partition portions) at both ends, which have an interval smaller than that between both end portions of a fixing film in a generatrix direction of the fixing film. In the second embodiment, the UFP decrease effect is obtained stably at a higher level by enabling the effect of the laminar flow Rw to be obtained more stably, compared to the first embodiment.

Figure 11:
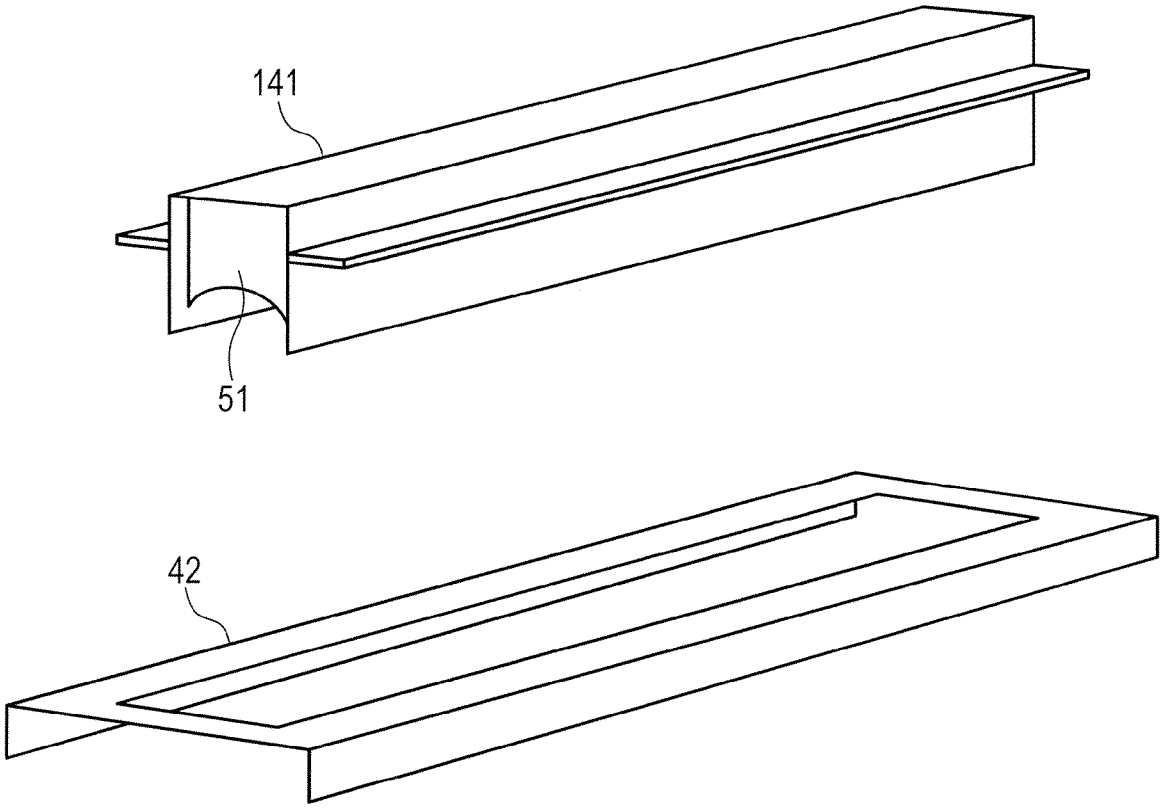
FIG. 11 is a perspective view of a retaining member and a top plate frame in a second embodiment of the present invention.
Figure 12A:
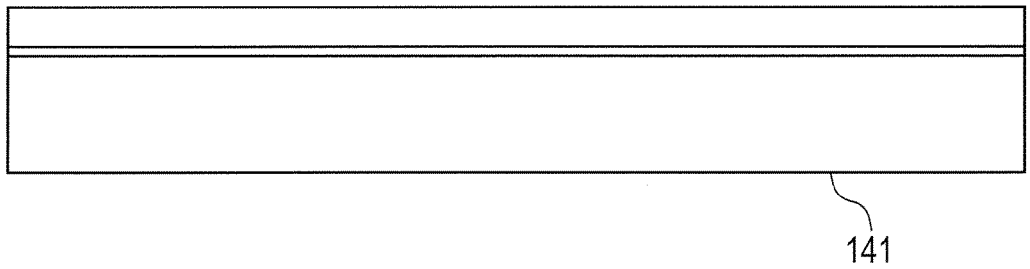
FIG. 12A is a front view of the retaining member in the second embodiment of the present invention when viewed from a conveyance direction.
Figure 12B:
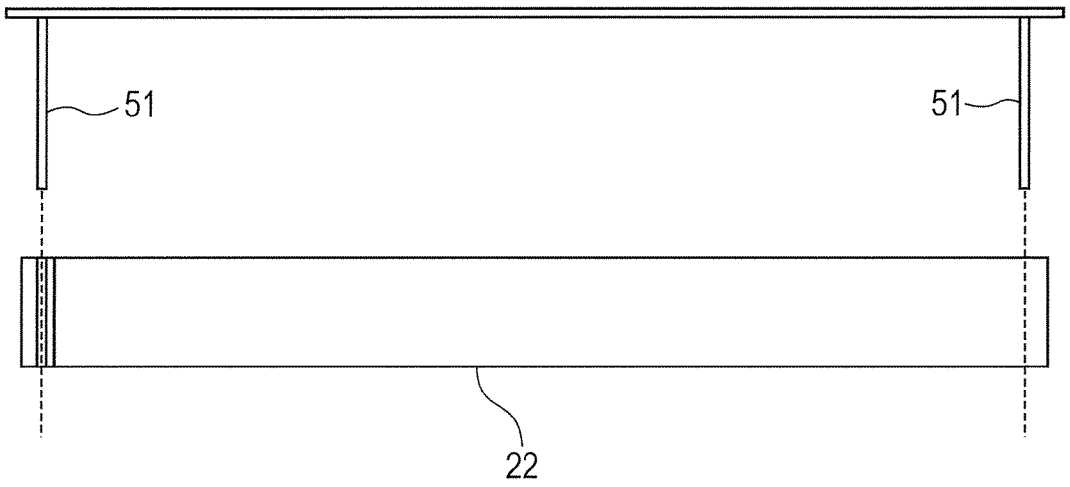
FIG. 12B is a view illustrating a positional relationship between partition plates on both end sides of the retaining member and a belt when viewed from the conveyance direction.
Figure 12C:
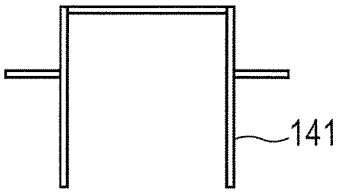
FIG. 12C is a sectional view of the retaining member in the view from a direction orthogonal to the conveyance direction.
Figure 12D:
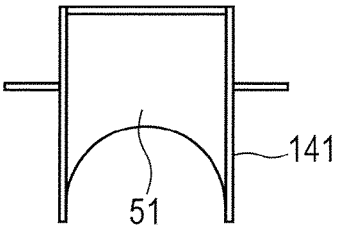
FIG. 12D is an external appearance view of retaining member in the view from the direction orthogonal to the conveyance direction.

FIG. 11 is a perspective view of a retaining member and a top plate frame in the second embodiment. The feature of the second embodiment lies in that partition plates 51 are provided in the vicinity of both ends of the retaining member in a longitudinal direction of a belt as illustrated in FIG. 12B. In the first embodiment, the effect of cancelling by a laminar flow cannot be used in a region not having the fixing film 22 in both end portions of the retaining member in the longitudinal direction of the belt, and hence there is inflow air, which degrades the effect of retaining an air current accordingly.

Figure 13:
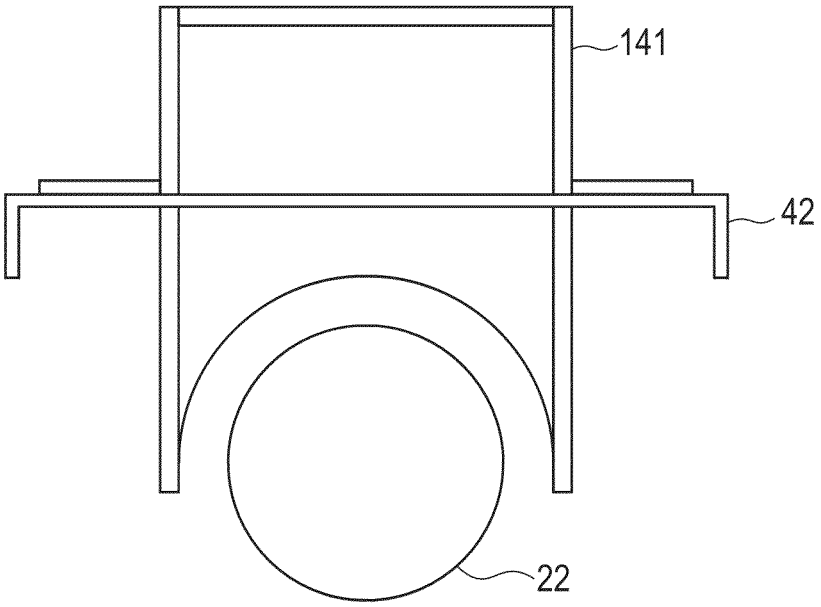
FIG. 13 is a positional relationship view of the retaining member, the top plate frame, and the belt in the second embodiment of the present invention when viewed from the direction orthogonal to the conveyance direction.

In contrast, in the second embodiment, as a positional relationship in the longitudinal direction illustrated in FIG. 12B and a positional relationship in a cross section with respect to the fixing film 22 illustrated in FIG. 13, the partition plates 51 are provided on inner sides from both ends of the fixing film 22 in the longitudinal direction. This can prevent inflow air from both ends and outflow air, with the result that the effect of cancelling by the laminar flow Rw involved in the rotation of the fixing film 22 can be sufficiently utilized.

Also, in the second embodiment, the parameter Y satisfies the expression $Y=S1/W\leq 0.7\times H$, the height su satisfies the expression $su\leq H/2$, and the minimum interval ka satisfies the expression $2\ mm\leq ka\leq 5\ mm$. More preferably, the parameter Y satisfies the expression $Y=S1/W\geq 0.9\times H$, the height su satisfies the expression $su\leq H/2$, and the minimum interval ka satisfies the expression $2\ mm\leq ka\leq 5\ mm$.

Figure 14:
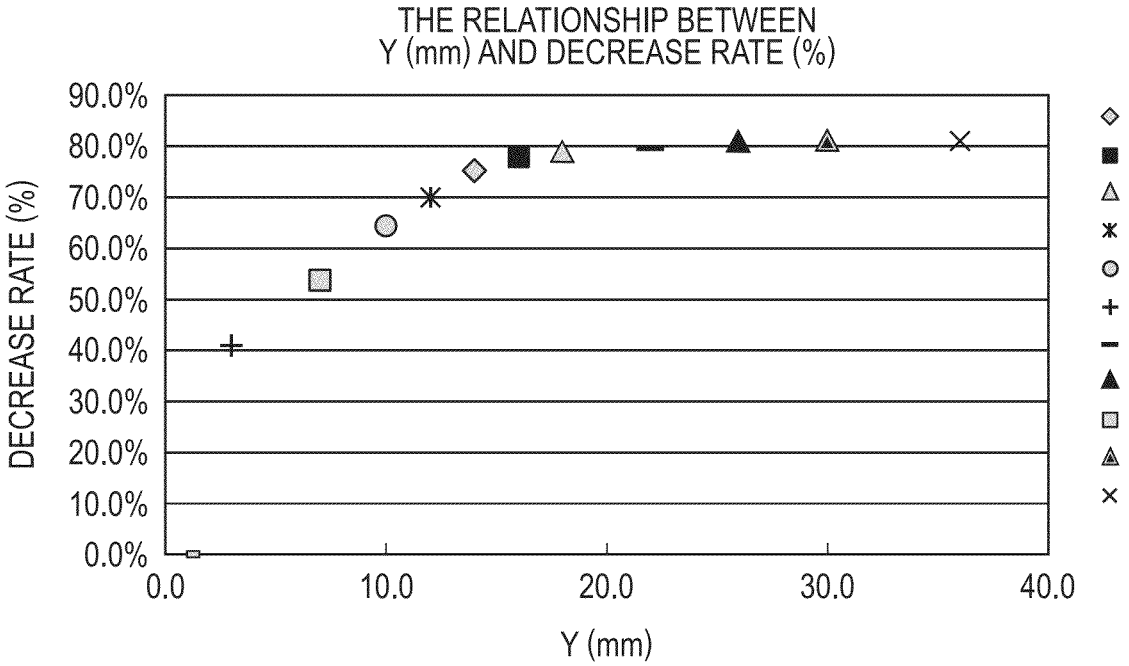
FIG. 14 is a graph showing a relationship between the height of a floating space and the UFP decrease rate in the second embodiment of the present invention.

Table 4 shows the results obtained by actually measuring the number (concentration) of the UFPs that are to outflow by setting the height su of the tip end of the upstream side portion of the retaining member 141 to 6 mm, setting the minimum interval ka between the retaining member 41 and the fixing film 22 to 3 mm, and changing the parameter Y of the ceiling part T. Further, FIG. 14 is a graph showing a relationship between the parameter Y and the decrease rate of Table. 4. Table 4 shows the results obtained by performing an experiment with respect to a configuration (FIGS. 9A and 9B) not having the retaining member 41 as Comparative Example (Ref).

Further, a method of evaluating a UFP outflow number involving filling a sealed chamber of 3 cubic meters with purified air, disposing an image forming apparatus in the chamber, and measuring the concentration of UFPs in the chamber immediately after printing an image of a printing ratio of 5% continuously for 5 minutes. For the measurement, a fast mobility particle sizer (FMPS 3091) (manufactured by TSI Holdings Co., Ltd.) was used.

TABLE 4

| | Y | Decrease rate % |
|---|---|---|
| Example 13 | 15 | 76% |
| Example 14 | 16 | 78% |
| Example 15 | 18 | 79% |
| Example 16 | 22 | 80% |
| Example 17 | 26 | 80% |
| Example 18 | 30 | 81% |
| Example 19 | 36 | 81% |
| Example 20 | 13.5 | 73% |
| Example 23 | 12 | 70% |
| Example 24 | 10 | 64% |
| Comparative Example 10 | 3 | 41% |
| Comparative Example (Ref) | — | 0% |

As is understood from the results of Table 4, the decrease rate increases by about 10% uniformly compared to the first embodiment. The reason for this is as follows. The retention is performed effectively by preventing inflow and outflow of an air current from the end portions.

It is understood that there is also the same tendency as that of the first embodiment in the relationship between the height parameter Y (mm) and the decrease rate (%). That is, as is understood from FIG. 14, when the decrease rate (%) is plotted with the parameter Y (mm) corresponding to the height of the retention space, the decrease rate increases along with an increase in the parameter Y. In the same way as in the first embodiment, in the case where the parameter Y is 10 (mm) or more, that is, the parameter Y is equal to or more of a value that is 0.7 times the height H of the fixing film, the decrease rate (%) is over 50%. More preferably, in the case where the parameter Y is 13.5 (mm) or more, that is, the parameter Y is equal to or more of a value that is 0.9 times the height H of the fixing film, the decrease rate (%) is substantially saturated (the change in concentration when the parameter Y changes by 1 mm (concentration/Y) is 2% or less).

The maximum particle diameter of the UFPs in Examples 13 to 20 in the second embodiment was about 250 nm, and the number of the UFPs was almost equal in Examples 13 to 20. Further, in Examples 23 and 24, the maximum particle diameter was less than 250 nm. In Comparative Example (Ref), the maximum particle diameter was 175 nm.

As described above, the satisfactory UFP decrease effect can be obtained by forming the retaining member 141 into a desired shape, that is, disposing the upstream side portion of the retaining member 141 in the conveyance direction of the recording material at a predetermined position (setting the height su and the minimum interval ka) and setting the parameter Y within a predetermined numerical value range.

Then, the area S1 may be changed due to the tolerances of the retaining member 141 and the components around the retaining member 41, the thermal expansion of the components, or the assembly rattling of a heating fixing device. However, in the second embodiment, even when the area S1 is changed, the 50% decrease effect of UFP can be obtained by setting the parameter Y to be larger than 0.7 times the height H. Furthermore, the UFP decrease effect can be obtained substantially stably by setting the parameter Y to be larger than 0.9 times the height H.

MODIFIED EXAMPLES

The exemplary embodiments of the present invention have been described above. However, the present invention is not limited thereto and can be modified variously without departing from the spirit of the present invention.

Modified Example 1

In the second embodiment, the retaining member has wall parts at both ends, which have an interval smaller than that of both ends of the belt in the rotation axis direction of the belt (belt longitudinal direction crossing the conveyance direction of the recording material). However, the retaining member may have wall parts at both ends, which have an interval larger than that of the both ends of the belt. In this case, the lengths in the belt longitudinal direction of the upstream side portion, the downstream side portion, and the ceiling part (top plate frame) T of the retaining member are equal to the interval between the wall parts, which is suitable when there is a margin in a setting space.

Modified Example 2

In the second embodiment described above, the constraint conditions of the height su and the minimum interval ka of the upstream side portion of the retaining member on the upstream side with respect to the nip portion regarding inflow air are described. However, no particular constraint conditions are provided to the downstream side portion of the retaining member on the downstream side with respect to the nip portion. When a height of the tip end position of the retaining member on the downstream side with respect to the nip portion from the recording material conveyance surface is defined as "tu", and a minimum interval between the retaining member on the downstream side with respect to the nip portion and the heating rotary member in the conveyance direction of the recording material is defined as "la", the "tu" and "la" can be set to any values. The "tu" and "la" can be set to the same value as "su" and "ka", respectively, and for example, the "tu" and "la" can be set so as to satisfy the expressions $tu \leq H/2$ and $1a \geq ka$.

Modified Example 3

In the first and second embodiments described above, the system in which the belt (fixing film) is used as the heating rotary member is employed, and the belt is rotated through use of the pressure roller serving as the pressure member. However, the present invention is not limited thereto. A pressure pad may be used as the pressure member, and the belt may be hung across a plurality of pulleys including a drive pulley.

Modified Example 4

In the first and second embodiments described above, the image heating device of the system using the belt (fixing film) as the heating rotary member is described. However, the present invention is not limited thereto and can also be applied to an image heating device of a system using a heat roller as the heating rotary member.

Modified Example 5

In the first and second embodiments described above, the example of the mode in which the ceiling part of the retaining member is disposed in parallel to the conveyance direction of the recording material as illustrated in FIGS. 1 and 5. However, the present invention is not limited thereto. The ceiling part may be disposed diagonally with respect to the conveyance surface or may have a difference in level and a curved line. Specifically, the parameter Y is defined as S/W, and the same effect as that in the first and second embodiments can be exhibited as long as the parameter Y satisfies the expression $Y \geq 0.7 \times H$.

According to the present invention, the number of release of UFPs can be suppressed substantially, and even in the case where the component dimensions are changed due to a tolerance, rattling, thermal expansion, or the like, the effect can be obtained stably.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-199467, filed Sep. 26, 2013, which is hereby incorporated by reference herein in its entirety.

What is claimed is:

1. A fixing device for fixing an unfixed toner image on a recording material while conveying and heating the recording material bearing the unfixed toner image at a nip portion, the fixing device comprising:

a rotary member configured to contact the unfixed toner image;

a pressure member configured to form the nip portion by contacting the rotary member; and a cover configured to cover the rotary member with a space between the rotary member and the cover, the cover including an upstream cover portion disposed upstream of the nip portion in a conveyance direction of the recording material at the nip portion, wherein in a cross section of the fixing device, the cross section being orthogonal to a generatrix direction of the rotary member, the following formulas are satisfied:

$S/W \geq 0.7 \times H$, $su \leq H/2$; and $ka \leq 5$ (mm), where H represents the shortest distance between the nip portion and a farthest surface portion of the rotary member farthest away from the nip portion, W represents the maximum width of the rotary member in the conveyance direction, and S represents an area of the space between the rotary member and the cover in a range of the maximum width W, su represents the shortest distance between the upstream cover portion and a virtual line obtained by extending the nip portion in the upstream direction upstream of the nip portion in the conveyance direction, and ka represents the shortest distance between the upstream cover portion and a surface portion of the rotary member farthest upstream from the nip portion in the conveyance direction.

2. A fixing device according to claim 1, wherein a following formula is satisfied:

$$S/W \geq 0.9 \times H.$$

3. A fixing device according to claim 1, wherein the cover comprises a partition portion having a surface orthogonal to the generatrix direction at an end portion in the generatrix direction.

4. A fixing device according to claim 3, wherein the partition portion is provided on an inner side with respect to an end portion of the rotary member.

5. A fixing device according to claim 1, wherein the cover includes a downstream cover portion disposed downstream of the nip portion in the conveyance direction, wherein in the cross section of the fixing device, the cross section being orthogonal to the generatrix direction of the rotary member, following formulas are satisfied:

$tu < H/2$; and $la > ka$, where la represents the shortest distance between the downstream cover portion and a surface portion of the rotary member farthest downstream from the nip portion in the conveyance direction, and tu represents the shortest distance between the downstream cover portion and a virtual line obtained by extending the nip portion in the downstream direction downstream of the nip portion in the conveyance direction.

6. A fixing device according to claim 1, wherein the rotary member is a tubular film.

7. A fixing device according to claim 6, further comprising a heater contacting an inner surface of the film.

8. A fixing device according to claim 7, wherein the heater forms the nip portion with the pressure member through the film.

9. A fixing device according to claim 1, wherein ka is equal to or more than 2 (mm).

* * * * *